United States Patent [19]

Klann

[11] 4,038,846

[45] Aug. 2, 1977

[54] ELECTRONIC COMBINATION LOCK

[76] Inventor: Paul Klann, P. O. Box 2398, Waynesboro, Va. 22980

[21] Appl. No.: 625,464

[22] Filed: Oct. 24, 1975

[51] Int. Cl.[2] ..... E05B 49/02

[52] U.S. Cl. ..... 70/220; 70/149; 70/150; 70/278; 70/279; 292/143; 361/172

[58] Field of Search ..... 70/214, 220, 271, 278, 70/149, 218, 133, 129, 283, 279, 150, 276; 317/134; 200/159 A; 292/143, 251.5

[56] References Cited

U.S. PATENT DOCUMENTS

| | | | |
|---|---|---|---|
| 629,638 | 7/1899 | Wiechers | 200/159 A |
| 1,130,994 | 3/1915 | Metzger | 200/159 A |
| 1,705,340 | 3/1929 | Robert | 70/214 |
| 2,082,806 | 6/1937 | Michel | 70/278 X |
| 2,936,606 | 5/1960 | Welch et al. | 70/150 X |
| 3,320,490 | 5/1967 | Beck et al. | 70/278 X |
| 3,340,710 | 9/1967 | O'Brien | 70/271 |
| 3,462,981 | 8/1969 | Leblanc | 70/220 X |
| 3,633,167 | 1/1972 | Hedin | 70/278 X |
| 3,656,327 | 4/1972 | Ford et al. | 70/278 X |
| 3,754,148 | 8/1973 | Nye | 317/134 X |
| 3,876,913 | 4/1975 | Perry | 317/134 |

FOREIGN PATENT DOCUMENTS

| | | | |
|---|---|---|---|
| 607,983 | 9/1948 | United Kingdom | 70/218 |

*Primary Examiner*—Roy D. Frazier
*Assistant Examiner*—Rodney H. Bonck
*Attorney, Agent, or Firm*—Howard A. Silber

[57] ABSTRACT

This electronic combination lock is operated by depressing the proper combination of pushbuttons mounted on the faceplate of a circular handle, then rotating the handle to open the bolt. The pushbuttons are held outwardly by radially extending spring wires within the handle that also provide electrical connection, when a pushbutton is depressed, to inclined contacts mounted to the rear of the faceplate. Electrical leads extend through a hollow shaft connected to the handle.

The bolt is restrained in the locked position by a magnetically actuated locking pin which projects into a bore in the bolt. The shaft is connected to the bolt by a spring. When the proper pushbuttons are selected, electrical circuitry disclosed herein actuates the magnet, removing the pin and permitting the bolt to be opened by handle rotation. If the wrong combination is depressed, an alarm signal is produced, the magnet is not actuated, and rotation of the handle expands the spring without moving the bolt.

10 Claims, 13 Drawing Figures

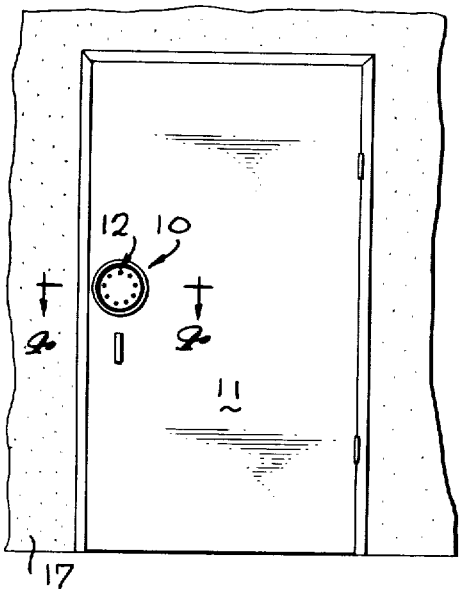
Fig. 1
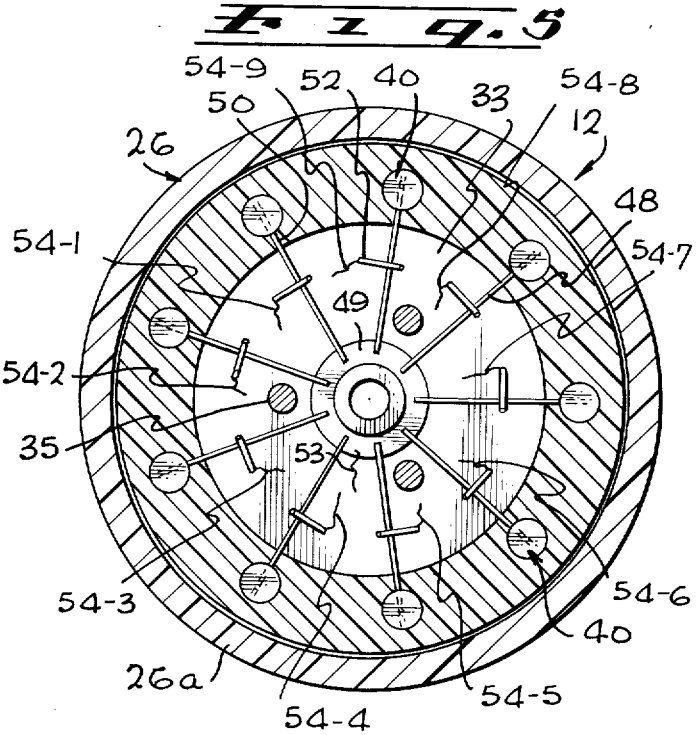
Fig. 5
Fig. 4
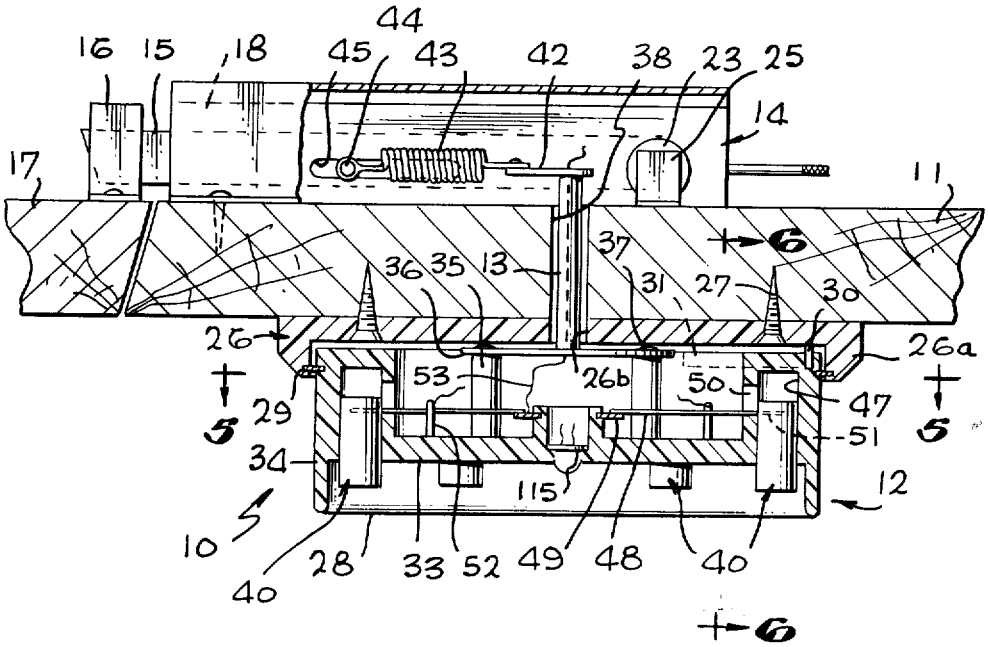

Fig. 6
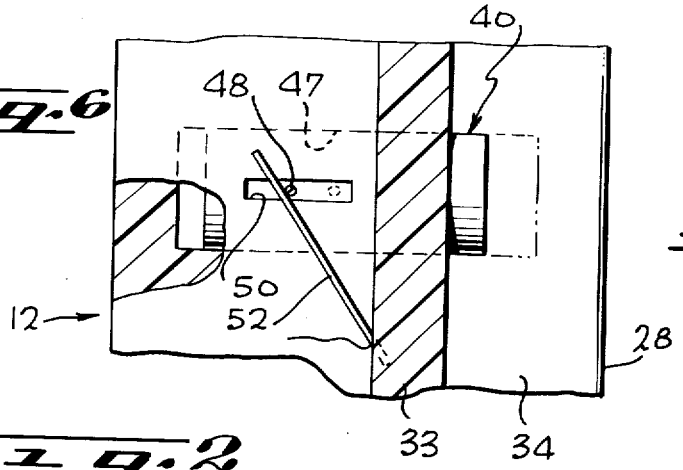
Fig. 10
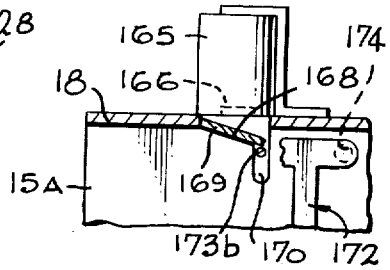
Fig. 2
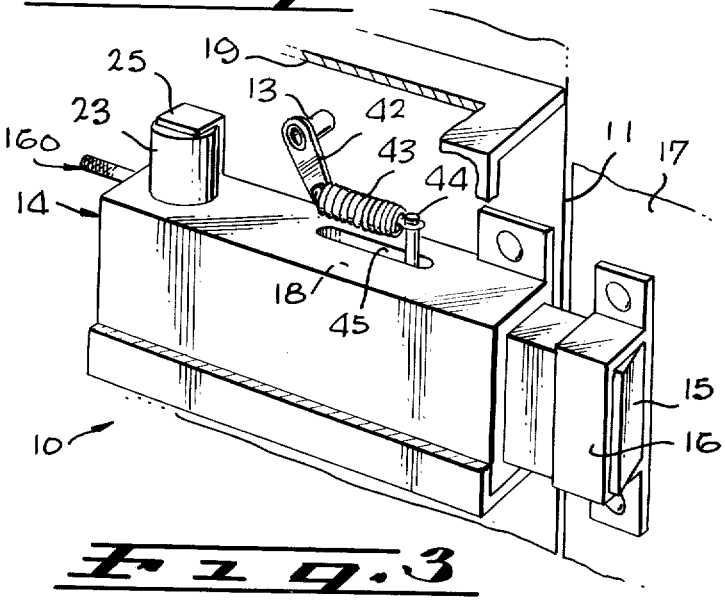
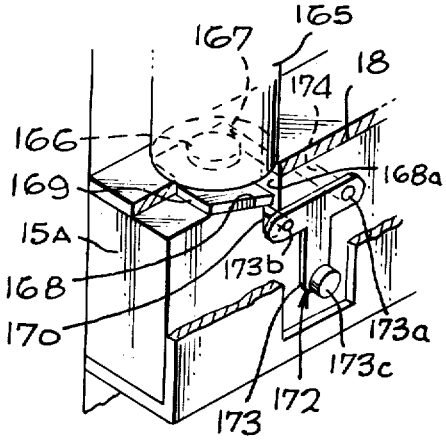
Fig. 3
Fig. 9
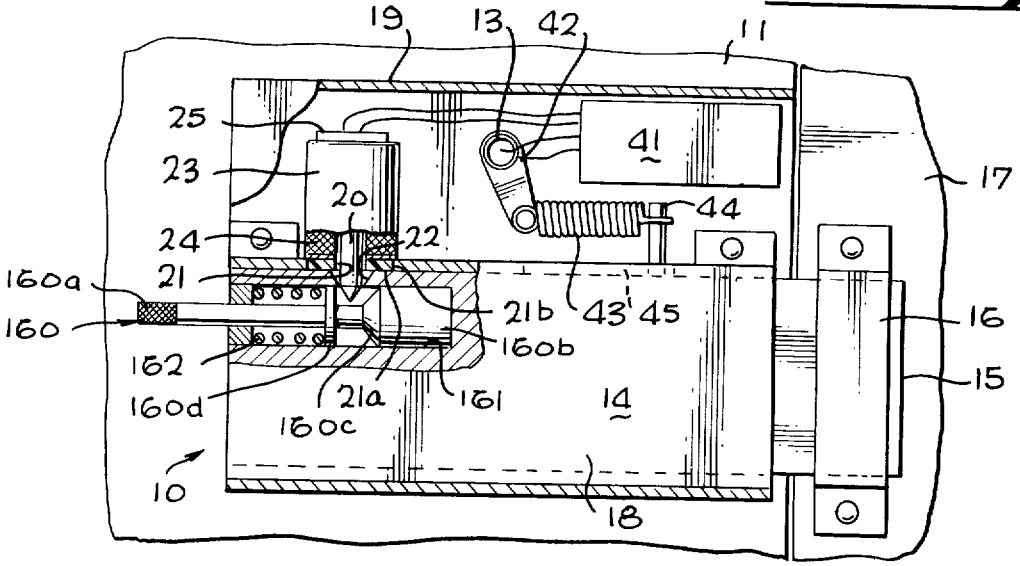

ELECTRONIC COMBINATION LOCK

BACKGROUND OF THE INVENTION

1. Field of the Invention

The present invention relates to the mechanical design and electrical circuitry for an electronic combination lock. Specifically, the invention relates to such a lock wherein the handle houses the pushbuttons and is mechanically isolated from the bolt so that rotation of the handle only will open the bolt when the proper combination of pushbuttons has been depressed.

2. Description of the Prior Art

Electronic combination locks offer the advantages over mechanical locks that there is no key to lose, that the combination is easily changed, and that there are no audible clicks associated with their operation to provide information to a potential lock picker. However, certain disadvantages typify prior art electronic combination locks. These include difficulty of installation, high cost, susceptability to tampering or forced entry and high power consumption or battery drain. A principle object of the present invention is to provide an electronic combination lock which overcomes these difficulties.

Prior art mechanical and electronic locks often were difficult to install, requiring a rectangular or oblong hole to be chistled in the door or frame. Typically a housing for the lock pushbuttons had to be mounted on the outside of the door in addition to a handle that mechanically operated the bolt when the proper combination was selected. Such installation problems discouraged the average homeowner from buying such a lock. In contrast, it is another object of the present invention to provide an electronic lock that is simple to install, requiring only a drill, and in which the pushbuttons are housed within the handle itself.

The complicated mechanical assemblies and electronic circuitry associated with prior art electronic combination locks lead to high cost. A further object of the present invention is to provide an electronic combination lock wherein simplified construction using few parts, many of molded plastic, results in low cost. A combined handle and pushbutton construction eliminates parts, simplifies operation, and reduces both manufacturing and installation costs.

Prior art electronic combination locks were susceptible to tampering in several ways. In some, the direct mechanical connection between the handle and the bolt permitted forced entry. In others, the electrical circuitry did not include sufficient safeguards to prevent unauthorized lock actuation, as for example by rapidly depressing random sets of pushbuttons.

Thus a further object of the present invention is to provide an electronic combination lock in which the handle is isolated from the bolt so as to prevent forced entry, and in which the electronic circuitry has sufficient safeguards so as to prevent unauthorized operation by someone who does not know the correct combination.

High power consumption or battery drain is typical of some electronic combination locks. For example, in some locks the bolt itself is moved by a solenoid or other electromechanical device. Considerable power is required to inpart this mechanical motion. In some lock circuits, considerable power is drawn even during the quiescent state when the lock is not being operated. In contrast, yet another object of the present invention is to provide an electronic combination lock in which the bolt is operated mechanically so as to reduce power consumption, and which uses electronic circuitry that draws substantially no current in the quiescent state.

SUMMARY OF THE INVENTION

These and other objectives are achieved by providing an electronic combination lock in which the pushbuttons are contained in the handle and wherein the handle itself is mechanically isolated from the bolt. The bolt normally is restrained in the locking position by a mechanically actuated locking pin which projects into a bore in the bolt. When the proper combination of pushbuttons is depressed in the correct order, and within a fixed time period, the locking pin is magnetically withdrawn from the bore. This permits the bolt to be opened by rotation of the handle which is connected to the bolt via a hollow shaft projecting rearwardly from the handle, and arm at the end of the shaft, and a spring. If the wrong combination is selected, the locking pin will not be removed, so that rotation of the handle will cause expansion of the spring but no movement of the bolt.

Simplicity of installation is achieved since only a single hole need be drilled through the door, as clearance for the shaft connected to the handle. Since the pushbuttons are mounted in the handle, no separate installation of a switch box is necessary. Moreover, since the handle and shaft are mechanically isolated from the bolt by the spring, forced rotation of the handle or shaft will not open the lock.

Low cost is achieved by the unique handle-pushbutton-contact assembly, most parts of which can be made of molded plastic. Low cost also is achieved by using radially extending spring wires within the handle for the dual function of maintaining the pushbuttons in an outwardly projecting orientation, and cooperating with inclined electrical contacts mounted to the rear of the faceplate to perform a switching function.

Electrical leads from the spring wires and contacts extend through the hollow shaft to a novel electronic circuit which draws little or no current in the quiescent state. The circuit includes a set of silicon controlled rectifiers or other electronic switch elements connected in series circuit. A turn-on signal is provided to each of these switch elements by a corresponding, selected pushbutton. With this arrangement, the switch elements can only be turned on sequentially in the order in which they are arranged in the series circuit. Accordingly, such turn-on can only be achieved by actuating the associated pushbuttons in the correct order.

Voltage is applied to a first terminal of the switching element series circuit for a fixed period of time beginning with depression of the correct first pushbutton in the combination. The remaining pushbuttons in the combination must be depressed within the period of time that the voltage is applied. Only if this is done will an output signal be provided from the other terminal of the switching element series circuit.

This output signal is used to gate current to the electromagnet or solenoid which withdraws the locking pin from the bolt. Low power consumption is achieved in two ways. First, voltage is only applied to the switching element series circuit for a brief period of time subsequent to depression of the first pushbutton. This current is relatively low. Similarly, current is only provided to the locking pin electromagnet for a short time duration. This electomagnet is not large, since the mass of the locking pin is relatively small.

The bolt is moved mechanically by rotation of the handle, and is not moved electromagnetically. The eliminates the need for a large, high current solenoid or magnet for moving the bolt.

Various provisions are made in the circuitry to safeguard against release of the lock when the wrong combination is depressed. Thus the lock will not work if (a) any pushbutton not in the combination is depressed, (b) the pushbuttons in the combination are depressed in the wrong order, (c) the pushbuttons in the combination are depressed simultaneously instead of sequentially, or (d) the correct pushbuttons are not depressed within a fixed period of time subsequent to actuation of the first pushbutton. These conditions also will cause an alarm signal to be generated.

BRIEF DESCRIPTION OF THE DRAWINGS

A detailed description of the invention will be made with reference to the accompanying drawings wherein like numerals designate corresponding elements in the several figures. These drawings, unless as diagrammatic or unless otherwise indicated, are to scale.

FIG. 1 is a pictorial view of the inventive electronic combination lock installed on the front of a door.

FIG. 2 is a pictorial view of the bolt mechanism of the inventive lock, as installed on the rear of the door of FIG. 1.

FIG. 3 is a rear view of the bolt assembly of FIG. 2, partly broken away and in section to show the locking pin and mechanical bolt-opening components.

FIG. 4 is a transverse sectional view of the handle and pushbutton assembly of FIG. 1 as viewed along the line 4—4 thereof.

FIG. 5 is a rear view of the handle and pushbutton assembly as seen along the line 5—5 of FIG. 4.

FIG. 6 is a detailed pictorial view of a typical pushbutton and switch assembly with the pushbutton shown depressed; the released position of the pushbutton is shown in phantom.

FIG. 9 is a fragmentary perspective view showing an alternative electromechanical means for restraining the bolt in the locked position.

FIG. 10 is a side view of the bolt restraining means of FIG. 9.

DESCRIPTION OF THE PREFERRED EMBODIMENTS

Figure 7:
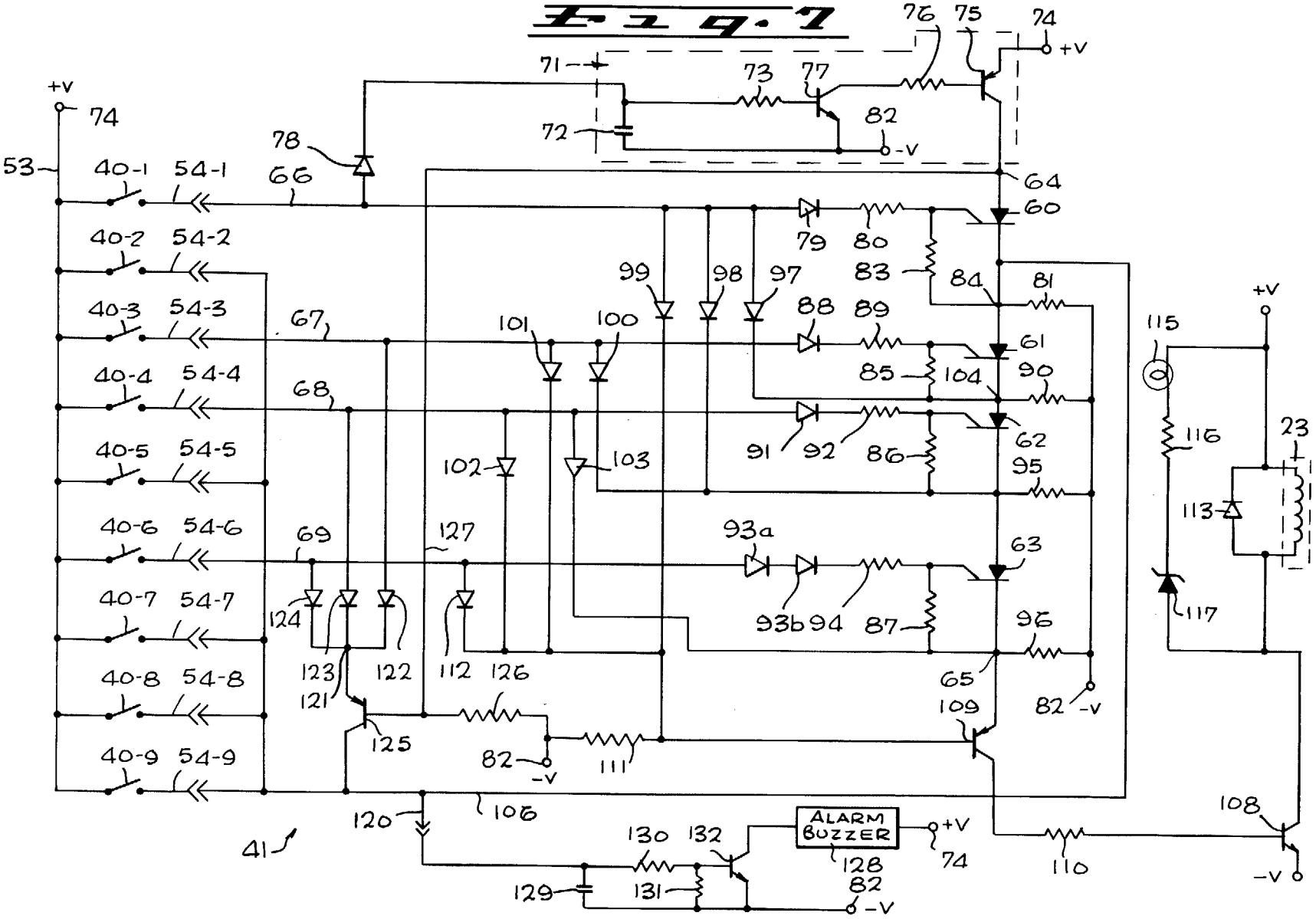
FIG. 7 is an electrical schematic diagram of the combination lock electronic circuitry.

The following detailed description is of the best presently contemplated modes of carrying out the invention. This description is not to be taken in a limiting sense, but is made merely for the purpose of illustrating the general principles of the invention since the scope of the invention best is defined by the appended claims.

Operational characteristics attributed to forms of the invention first described also shall be attributed to forms later described, unless such characteristics obviously are inapplicable or unless specific exception is made.

A typical installation of the inventive electronic combination lock 10 is shown in FIGS. 1, 2 and 3. Attached to the front of a door 11 is a combined handle and pushbutton assembly 12. This is connected by a single shaft 13 (FIGS. 2 and 4) to a bolt assembly 14 attached to the rear of the door 11. In the locked position shown, a bolt 15 projects from the assembly 14 into a generally U-shaped receptacle 16 that is affixed to the wall or door frame 17. The bolt assembly 14 is covered by a housing 19.

The bolt 15 can slide within a generally U-shaped channel 18 that is part of the assembly 14. However, the bolt 15 normally is restrained in the locked position of FIG. 2 by a pin 20 (FIGS. 2 and 3) that projects through an opening 21 in the channel 18 into a bore 22 in the bolt 15. In the embodiment of FIGS. 2 and 3, the pin 20 is part of a solenoid 23 having a coil 24 and attached by a frame 25 to the channel 18. If the channel 18 is of ferrous material, a plastic or other non-magnetic insert 21a surrounds the opening 21 and seats within a large aperature 21b so that the channel 18 will not interfere with the magnetic operation of the solenoid 23. The assembly 12 (FIGS. 1 and 4) includes a circular mounting plate 26 that is fastened to the door 11 by screws 27. A handle 28 seats within a peripheral flange 26a of the mounting plate 26 and may be rotatably connected thereto by means of a snap ring 29. A cooperating pin 30 and groove 31 limit the extent of rotation of the handle 28.

The handle 28 includes a disc-shaped faceplate 33 and a unitary, cylindrical skirt 34 at its periphery. A set of standoffs 35 project rearwardly from the faceplate 33. A disk 36 affixed to the front end of the shaft 13 is connected to these standoffs 35 by means of screws or other fasteners 37. With this arrangement, rotation of the handle 28 imparts rotation to the shaft 13. The shaft 13 itself projects rearwardly through a central opening 26b in the mounting plate 26 and through a hole 38 drilled through the door 11. Advantageously the faceplate 33, the skirt 34 and the standoffs 35 all are part of a unitary, molded plastic assembly.

Mounted on the faceplate 33, as part of the assembly 12, are a plurality of pushbuttons 40. In the embodiment shown, there are nine such pushbuttons 40–9, respectively numbered 40–1 through 40–9. When the proper combination of pushbuttons 40 is depressed, an electrical circuit 41, the details of which are shown in FIG. 7, provides a current to actuate the solenoid 23 (FIG. 2). Such actuation withdraws the pin 20 from the bore 22, thereby permitting the bolt 15 to be moved to the open position.

To this end, the rear end of the shaft 13 is affixed to an arm 42 (FIG. 2) that is connected by a spring 43 to a peg 44 which projects from the bolt 15 through an elongated slot 45 in the channel 18.

When the pin 20 is withdrawn upon selection of the proper combination, rotation of the handle 28 and shaft 13 will be communicated via the arm 42, the spring 43 and the peg 44 so as to slide open the bolt 15. If no pushbuttons 40 are depressed, or if the wrong combination is selected, the solenoid 23 will not be actuated and the pin 20 will remain within the bore 22, thereby restraining the bolt 15 in the locked position. Under these conditions, rotation of the handle 28 and the shaft 13 will merely expand the spring 43 without moving the bolt 15.

The pushbutton 40 assembly is shown in FIGS. 4, 5, and 6. Each pushbutton 40 consists of a short plastic rod slideably received in a respective bore 47 in the faceplate 33. A relatively stiff spring wire 48 extends radially from a central metal ring 49 through a slot 50 communicating to the bore 47 and into a hole 51 through the pushbutton 40. The ring 49 is affixed to the faceplate 33.

The spring wire 48 maintains the pushbutton 40 in a normal position projecting outwardly from the front of the faceplate 33. When the pushbutton 40 is depressed and released, the spring force of the wire 48 returns the pushbutton to this normal position.

Each spring wire 48 also serves as part of a switch associated with respective pushbutton 40. The other switch member is an inclined contact 52 fastened to the rear of the faceplate 33 in alignment with respective spring wire 48. In the rest position, the spring wire 48 does not touch the incline contact 52. However, when the pushbutton 40 is depressed, the wire 48 touches the contact 52 (FIG. 6) to complete an electrical connection. Since the contact 52 is inclined, a wiping, sliding contact is made when the pushbutton 40 is depressed that insures good electrical connection. The wiping also has a self-cleaning effect insuring long-lifetime switch operation.

All of the spring wires 48 are electrically connected to the circuit 41 via the metal ring 49 and an electrical lead 53 that extends through the shaft 13 which advantageously is hollow. Individual electrical leads 54–1 through 15–9 from each of the contacts 52 also run through the hollow shaft 13 to the circuit 41.

In the embodiment of FIG. 7, the circuit 41 includes a set of silicon controlled rectifiers 60 through 63 connected in series between a first terminal 64 and an output terminal 65. To actuate the solenoid 23, the SCR's 60 through 63 must be turned on in that order. Turn-on signals to these SCR's are provided from a selected subset of the switches 40–1 through 40-9 via the respective lines 66–69. In the typical embodiment of FIG. 7, these are connected to switches 40–1, 40–3, 40–4 and 40–6 so that the pushbutton combination is 1-3-4-6.

Normally, no voltage is applied to the terminal 64. However, when the first switch in the combination is depressed, a timing circuit 71 applies a positive voltage to the terminal 64 for a duration of time established by a capacitor 72 and a resistor 73. The voltage is supplied from a terminal 74 via the emitter to collector path of a transistor 75 that receives its base signal via a resistor 76 from a transistor 77. When the first switch in the combination is closed (herein switch 40-1) a positive voltage is supplied via a diode 78 to turn on the transistors 77 and 75, and thereby apply the voltage to the terminal 64. While the switch 40-1 is depressed, the capacitor 72 is charged. When the switch 40-1 is released, the capacitor 72 begins to discharge. The transistor 77 and 75 stay on while the capacitor 72 is discharging. This establishes a time period during which the remaining switches in the combination must be closed to actuate the lock.

Closure of the switch 40-1 also applies a turn-on signal to the gate of the SCR 60 via a diode 79 and a resistor 80. This turns on the SCR 60, and current flows in the path from the positive terminal 74 via the transistor 75, the SCR 60 and a resistor 81 to the negative voltage terminal 82. A resistor 83 connects the output terminal 84 from the SCR 60 to the gate of that SCR, and serves to hold that SCR off prior to closure of the switch 40-1. Similar resistors 85–87 are provided for the respective SCR 61–63.

When the next switch in the combination (herein switch 40-3) is closed subsequent to actuation of the switch 40-1, a turn-on signal is provided to the SCR 61 via a diode 88 and a resistor 89. This turns on the SCR 61, and current flow now is from the terminal 64 through the SCR's 60 and 61 and a resistor 90 to the negative voltage terminal 82. Note that if the switch 40-3 were depressed out of order prior to turn-on of the SCR 60, the SCR 61 would not have turned on since there would be no voltge applied to the anode from the terminal 84.

Similarly, the SCR's 62 and 63 can be turned on in order by sequential closure of the switches 40-4 and 40-6. These switches provide respective turn-on signals to the SCR 62 via a diode 91 and a resistor 92, and to the SCR 63 via two diodes 93a, 93b and a resistor 94. Negative voltage is applied to the cathodes of the SCR 62 and 63 by respective resistors 95 and 96. When all of the SCR's 60-63 have been turned on, the voltage at the output terminal 65 goes positive, thereby providing an output signal to actuate the solenoid 23 in a manner described below.

A set of diodes 97 through 103 are connected to prevent the simultaneous turn on of two or more of the SCR's 60-63. For example, the diode 97 is connected between the line 66 from the switch 40-1 to the output terminal 104 of the SCR 61. If the switches 40-1 and 40-3 simultaneously are depressed, a positive voltage will be supplied to the terminal 104 via the diode 97. The SCR 60 will turn on applying a positive voltage to the terminal 84. Since both the anode and the cathode of the SCR 61 will be at the same positive potential, the signal applied to the gate of the SCR 61 from the closed switch 40-3 will not cause turn on of the SCR 61 since there is no potential difference across that SCR. This insures that the combination lock must be actuated by sequential depression of the appropriate pushbuttons 40.

If any switch not in the combination is depressed, no output signal will be obtained at the terminal signal 65 and the solenoid 23 will not be actuated. To this end, all of the switches not in the combination are connected to a common line 106 leading to the output terminal 84 of the SCR 60. If any of these switches (herein switches 40-2, 40-5, 40-7, 40-8 and 40-9) are closed, a positive voltage will be applied to the terminal 84. Since the anode and cathode of the SCR 60 now are at the same potential, the SCR 60 will turn off. As a result, the voltage path through the SCR series circuit is opened, so that the output terminal 65 remains negative. No output is obtained.

The entire combination must be depressed during the time duration that the transistor 75 is on. If this is not done, at least one of the SCR's 60-63 will remain off, and again no positive voltage output will be supplied to the terminal 65. Of course, after the end of the time period established by the circuit 71, the transistor 75 goes off so that positive voltage is disconnected from the terminal 64 and no output signal is obtained at the terminal 65.

If the correct combination of pushbuttons is depressed in the proper order, within the fixed time period set by the circuit 71, an output signal is obtained at the terminal 65 and the solenoid 23 is actuated. To this end, current to the solenoid coil 24 is switches on by a transistor 108 that receives its base signal from the terminal 65 via a transistor 109 and a resistor 110. The transistor 109 normally is biased on by a negative voltage supplied via a resistor 111, but is held off while any pushbutton in the combination is depressed by the positive signal supplied via a respective diode 99, 101, 102 or 112.

Thus if all of the SCR's 60-63 are turned on within the fixed time period, and the combination pushbuttons are released, the terminal 65 will go to a positive potential, the transistor 109 will on, and the transistor 108 will switch on current to the solenoid coil 24 for the remainder of the time period fixed by the circuit 71. This will actuate the solenoid 23 and release the bolt 15 to be opened by rotation of the handle 28. A diode 113 provides surge protection as energy is dissipated from the coil 24 after the transistor 108 turns off. Battery energy is conserved, since the solenoid 23 cannot remain actuated for more than the time period fixed by the circuit 71.

If the lock circuitry 41 is battery powered, the condition of the battery is indicated by a lamp or a light emitting diode 115 connected in series with a resistor 116 and a Zener diode 117 across the solenoid coil 24. If the battery voltage is greater than the breakdown voltage of the Zener diode 117, the light 115 will go on when the solenoid 23 is actuated. However, if the battery voltage is low, the light 115 will remain off. Advantageously the Zener breakdown voltage is selected to be below the nominal battery voltage, but higher than the minimum voltage which will actuate the solenoid 23. Thus the non-turn-on of the lamp 115 will indicate to the user that although sufficient energy remains presently to operate the solenoid 23, the battery is low and should be replaced. In the embodiment of FIG. 4, the light source 115 is mounted on the handle 28 at the center of the faceplate 33.

The circuit 41 provides an alarm signal to a terminal 120 whenever a pushbutton not in the combination is depressed, or when one of the pushbuttons in the combination is depressed either prior to actuation of the correct first pushbutton or subsequent to time-out of the circuit 71.

As noted earlier, whenever any pushbutton not in the combination is depressed, a positive signal is provided on the line 106. This is provided as the alarm signal to the terminal 120. Further, all but the first pushbuttons in the combination are connected to a common terminal 121 via respective diodes 122 through 124, which components comprise an OR-gate. The terminal 121 is connected to the line 106 via a transistor 125 that is biased on by a negative voltage supplied via a resistor 126. Also the base of the transistor 125 is connected to the terminal 64.

With this arrangement, prior to closure of the first pushbutton 40-1, and also subsequent to time-out of the circuit 71, the terminal 64 is not at positive potential, so that the transistor 125 is biased on. Thus during either of these times if any of the switches 40-2, 40-3 or 40-6 is closed, a positive signal will be provided via the respective diode 122-124 and the transistor 125 to the output terminal 120. That is, an alarm signal will be generated indicating either that the wrong combination pushbutton has been depressed first, or that one of the combination pushbuttons has been closed after the end of the fixed time duration. However, during the time period that the circuit 71 provides an output to the terminal 64, the transistor 125 is held off so that closure of the combination switches 40-3, 40-4 and 40-6 does not produce an alarm signal.

Optionally, the signal on the line 20 may be used to actuate an alarm buzzer 128 for a period of time established by a capacitor 129 and a pair of resistors 130 and 131 connected between the terminal 120 and a transistor 132. Occurrence of the alarm signal on the terminal 120 turns on the transistor 132 to sound the alarm buzzer 128. The signal also charges the capacitor 129, which maintains the transistor 132 and the alarm buzzer 128 on after termination of the alarm signal on the line 120 for a period of time determined by the RC time constant.

Figure 8:
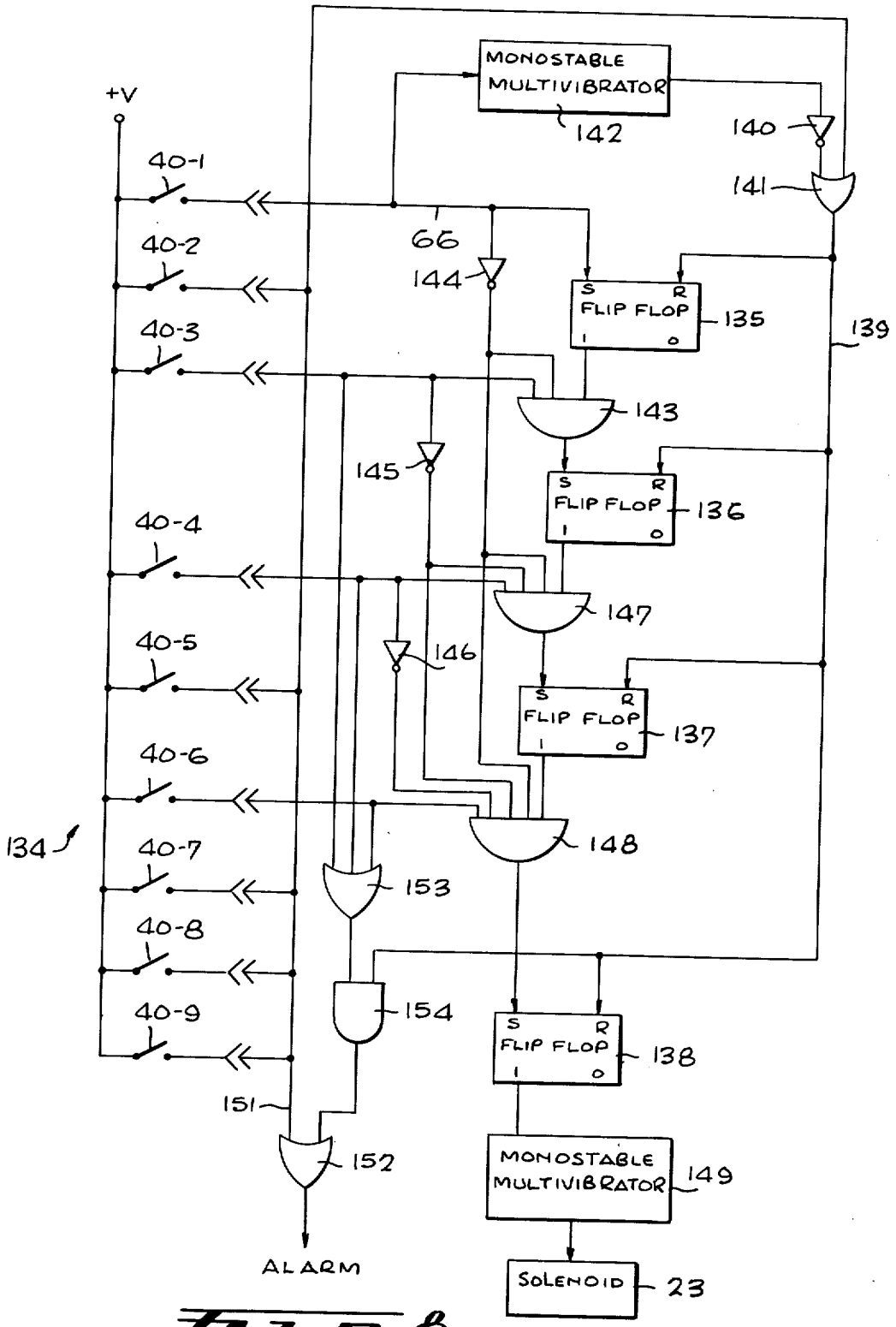
FIG. 8 is an electrical schematic diagram of alternative electronic lock circuitry.

When manufactured in large quantities, it may be economical to implement the combination lock circuitry using an integrated circuit chip. Illustrative logic 134 that may be utilized in such a chip is shown in FIG. 8. There, a set of flip-flops 135 through 138 connected in series circuit perform the same switching element role as the SCR's 60-63 in the circuit of FIG. 7. Normally the flip-flops 135-138 are reset to the zero state by a reset signal supplied on a line 139 from an inverter 140 and an OR-gate 141.

When the first switch in the combination (herein the switch 40-1) is closed, the output of a monostable multivibrator 142 goes high, so that the output from the inverter 140 is low. This terminates the reset signal on the line 139 and allows the first flip-flop 135 to be set to the "1" state by the signal on the line 66.

The monostable multivibrator 142 provides a high output for a fixed duration of time, and thus serves the same function as the timing circuit 71. During this time, all of the flip-flops 135–138 must be set to the "1" state by sequential depression of the switches 40-1, 40-3, 40-4 and 40-6. When the switch 40-3 is closed, the flip-flop 136 is set by a signal supplied from an AND-gate 143 that is enabled by the "1" output from the flip-flop 135. The flip-flop 136 cannot be set simultaneously with the flip-flop 135 since the AND-gate 143 also is enabled by the output of an inverter 144 connected to the line 66. Thus when the switch 40-1 is depressed, the inverter 144 provides a low output and the AND-gate 143 is disabled.

Similarly, the flip-flops 137 and 138 only can be set by sequential depression of the switches 40-4 and 40-6. Actuation by simultaneous depression of more than one of these switches is prevented by the cooperation of the inverters 145 and 146 and the AND-gates 147 and 148.

An output signal is obtained from the "1" output terminal of the last flip-flop 138 in the series circuit. This signal is used to trigger a monostable multivibrator 149 that energizes the solenoid 23 for a fixed period of time. Alternatively, the multivibrator 149 may be omitted and the output from the flip-flop 138 used directly to gate power to the solenoid 23. In that instance, the solenoid 23 will be on for the remainder of the time period fixed by the multivibrator 142. As soon as the multivibrator 142 timed period is over, a high output is obtained from the inverter 140 that is supplied via the OR-gate 141 as the reset signal on the line 139.

As in the circuit 41, depression of any switch that is not in the combination produces an alarm signal, in this case via a line 151 and an OR-gate 152. The signal on the line 151 also is supplied via the OR-gate 141 and the line 139 to reset the flip-flops 135-138 if an incorrect pushbutton is depressed.

Also similar to the circuit 41, if any of the switches in the combination is erroneously depressed first, or is closed after the end of the multivibrator 142 time period, an alarm signal is produced via an OR-gate 153 and an AND-gate 154 that is enabled by the reset signal on the line 139.

The inventive lock 10 can be opened mechanically from inside the door 11 without use of the electronic combination circuitry. This is accomplished by pulling on the knurled end 160a of a rod 160 projecting from the end of the bolt 15 opposite from the receptical 16 (FIG. 3). This rod 160 terminates at an enlarged end 160b situated within a cavity 161 inside of the bolt 15. The bore 22 opens into the cavity 161 so that the end of the pin 20 projects into that cavity. The shoulder 160c of the enlarged end section 160b is tapered, as is the end of the pin 20. Thus when the rod 160 is pulled outward, the tapered shoulder 160c pushes the pin 20 upward. The bore 22 also is tapered, so that continued pulling of the rod 160 will cause the pin 20 to ride upward out of the tapered bore 22, thereby releasing the bolt 15 which is then slid to the open or unlocked position by continued pulling on the rod 160. A spring 162 within the cavity 161 pushes against a flange 160d so as to bias the rod 160 to the rest position shown in FIG. 3.

An alternative bolt-restraining mechanism is shown in FIG. 9. Referring thereto, the solenoid 23 is replaced by an electromagnet 165 having its pole piece 166 situated slightly above an opening 167 in the channel 18. The non-ferrous bolt 15A has an inclined recess 168a beneath the opening 167 defined by a shoulder 168 that slants downward toward the receptical 16. A flat rectangular or circular block 169 of ferrous material seats at an incline within the recess 168a when the bolt 15A is in the locked position shown in FIGS. 9 and 10. Opening of the bolt 15A is prevented, since the block is caught between the opposing faces of the recess 168a and the opening 167 in the channel 18. However, when the electromagnet 165 is energized by the circuit 41 or 134, the block 169 is attracted out of the recess 168a up to the pole piece 166. As a result, the bolt 15A is released and can be slid open by rotation of the handle 28 as described above.

Mechanical release of the block 169 and opening of the bolt 15A from inside the door 11 is accomplished using the knob assembly 172 of FIGS. 9 and 10. A T-shaped bar 173 includes a pivot pin 173a which is received in a hole 174 in the bolt 15A, and has a block-removing pin 173b that is received in a groove extending downward into the bolt 15A from the recess 168a. A knob 173c extends outwardly from the T-bar 173. When the knob 173c and the T-bar 173 are rotated about the pivot pin 173a, the pin 173b pushes the block 169 out of the recess 168a, permitting the bolt 15A to be slid to the open position by translational movement of the knob 173c.

Figure 11:
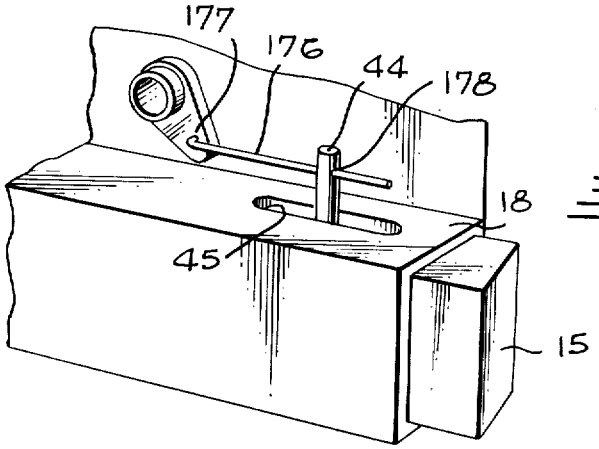
FIGS. 11, 12 and 13 are fragmentary perspective views like FIG. 2 showing alternative isolated motion imparting means.

As an alternative to the spring 43 connection shown in FIGS. 2 and 3, mechanical isolation between the shaft 13 and the peg 44 can be acheived using the friction-slip wire arrangement shown in FIG. 11. There a wire 176 is attached at one end to a boss 177 affixed to the shaft 13. The other end of the wire 176 extends through a tight fit hole 178 in the peg 44. For example, the wire 176 may have a diameter of 20 mils and the hole 178 may have a diameter of 22 mils. Advantageously the wire 176 has a slight curve or bend.

When the handle 28 is rotated, if the bolt 15 is restrained, the wire 176 will slip in the hole 178. However if the correct combination has been depressed, there is sufficient friction between the wire 176 and the inside surface of the hole 178 so that rotation of the handle 28 and shaft 13 will pull the wire 176 and the peg 44, thereby moving open the bolt 15.

Figure 12:
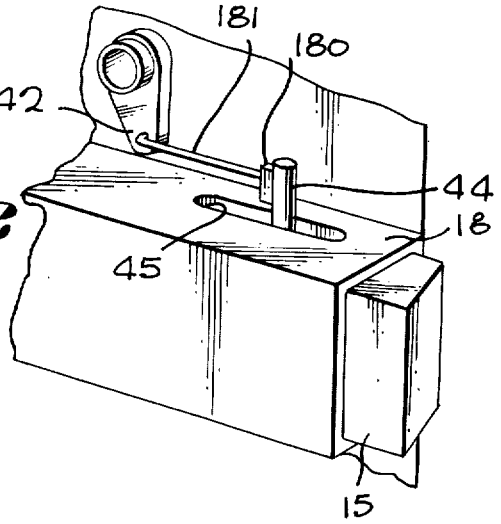

In FIG. 12, mechanical isolation is acheived by means of a permanent magnet 180 attached to a rod 181 extending from the arm 42. The peg 44 is of a ferrous material. When the shaft 13 is rotated, the arm 42, the rod 181 and the magnet 180 will pull the peg 44 and bolt 15 to the open position if the bolt 15 has been released. However if the bolt 15 is restrained, the magnet 180 will slip along, or free of the peg 44. Optionally, the peg 44 may be itself non-ferrous, but have another magnet (not shown) affixed to it to cooperate with magnet 180.

Although the unitary handle and pushbutton assembly is illustrated in FIGS. 3 and 4 as being circular, the invention of course is not so limited. Any geometric shape may be employed. For example, if the pushbuttons are arranged linearly or rectangularly, the spring wires may be likewise arranged. Further, although the inclined contacts 52 are illustrated as being behind the spring wires 48 so that depression of a pushbutton 40 makes the electrical connection, this is not required. The inclined contacts could be in front of the spring wires, normally in electrical connection therewith, so that depression of a pushbutton breaks the electrical circuit.

Furthermore, the faceplate and pushbutton assembly need not be part of the rotary handle. The faceplate and pushbutton assembly may be stationary, and a separate relatively rotatable handle and shaft might be provided.

Figure 13:
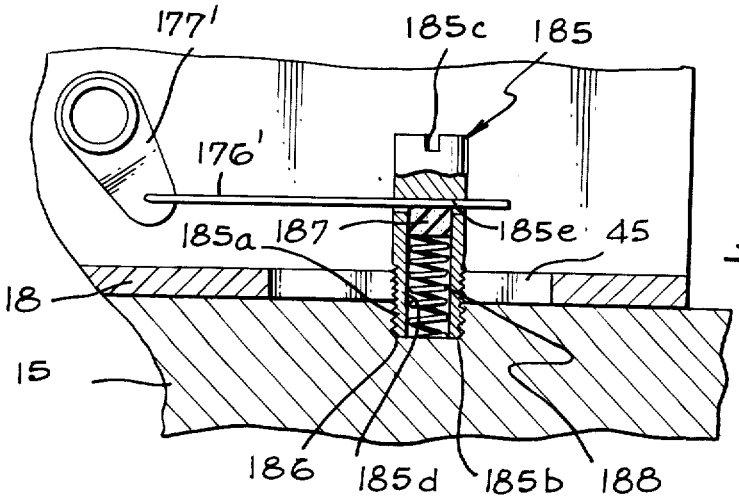

Another isolated motion imparting means is shown in FIG. 13 which is similar to FIG. 11. Here the peg 185 includes threads 185a that screw into a threaded hole 186 in the bolt 15. The peg 185 can be tightened so that the end 185b bottoms out in the hole 186 using a screwdriver that fits into a slot 185c. A bore 185d (or optionally, a slot) extends into the peg 185 from the end 185b thereof, and communicates with a lateral hole 185e through which the wire 176' projects. Friction is provided by a rubber bumper 187 that seats within the bore 185d and is biased by a spring 188 into contact with the wire 176'.

When the handle 28 and shaft 13 are rotated, the boss 177' imparts motion to the wire 176'. The wire either slides through the hole 185e, if the bolt 15 is restrained, or moves open the bolt 15 by pulling the peg 185 if not restrained.

Intending to claim all novel, useful and unobvious features shown or described, the inventor makes the following claims:

1. A lock, comprising:

a bolt moveable in the housing between a locking position and an open position, a solenoid having a pin insertable into a bore in said bolt so as to prevent said bolt from moving from said locking position, said solenoid pin being removeable from said bore to permit movement of said bolt to said open position, a moveable member, connected by a spring to said bolt, so that movement of said member imparts opening movement to said bolt when said solenoid pin is removed, and wherein like movement of said member causes expansion of said spring without imparting motion to said bolt when said bolt is restrained in said locking position by said inserted solenoid pin, said moveable member including a shaft mounted for rotation, an arm affixed to one end of said shaft and attached to said spring, and a handle mounted to the other end of said shaft, an electronic combination lock for providing a current to actuate said solenoid and thereby remove said solenoid pin from said bore when the proper combination is selected, said lock having combination selection switches mounted on said handle, said handle including a disc-shaped faceplate and a cylindrical skirt at the periphery of said faceplate, there being a plurality of pushbuttons disposed in a circle on said faceplate, a like plurality of spring wires extending radially from adjacent the center of said faceplate, rearwardly thereof, in spoke-like array, the outer end of each of said spring wires being connected to a respective one of said pushbuttons, said spring wires thereby maintaining said pushbuttons in an outwardly projecting position, a like plurality of inclined contacts affixed to the rear of said faceplate, each being radially aligned with a respective one of said spring wires and positioned between the respective pushbutton and said faceplate center, so that upon depression of any pushbutton the spring wire associated therewith will be deflected rearward of said faceplate into electrical connection with the associated contact, and electrical circuitry means connecting all of said spring wires and each of said contacts to said electronic combination lock so that said lock is actuated upon depression of the proper subset of said pushbuttons.

2. A lock, comprising:

a bolt moveable in a housing between a locking position and an open position, restraining means for preventing said bolt from moving from said locking position, said restraining means being releasable to permit movement of said bolt to said open position, said restraining means comprising a solenoid mounted to said housing and having a pin normally inserted into a bore in said bolt, isolated motion imparting means for moving said bolt from said locking position to said open position when said restraining means is released, said motion imparting means being itself moveable but mechanically isolated from said bolt so that no motion is imparted to said bolt when said motion imparting means is moved while said bolt is restrained in said locking position, and unlatching means for selectively releasing said restraining means to permit said bolt to be moved to said open position by said motion imparting means, said unlatching means comprising an electronic combination lock having a set of switches and circuitry for providing an actuating current to said solenoid so as to cause removal of said pin from said bore and thereby release said bolt when a certain subset of said switches are operated, and wherein the axis of said pin is generally perpendicular to the direction of movement of said bolt, the end of said pin being tapered, together with manual bolt opening means comprising:

a cavity in said bolt communicating with said bore so that said pin tapered end projects into said cavity, said bore also being tapered, and an opening from said cavity to the exterior of said bolt, and a rod extending through said opening and having an enlarged end section within said cavity, said end section having a tapered shoulder adapted to engage the tapered end of said pin so as to wedge said pin out of said cavity and bore as said rod is pulled manually in a direction outwardly of said opening to open said bolt.

3. A lock comprising:

a bolt movable in a housing between a locking position and an open position, restraining means for preventing said bolt from moving from said locking position, said restraining means being releasable to permit movement of said bolt to said open position, said restraining means comprising a restraining member insertable into a recess in said bolt, and an electromagnet for magnetically removing said restraining member from said recess when energized, isolated motion imparting means for moving said bolt from said locking position to said open position when said restraining means is released, said motion imparting means being itself movable but mechanically isolated from said bolt so that no motion is imparted to said bolt when said motion imparting means is moved while said bolt is restrained in said locking position, and unlatching means for selectively releasing said restraining means to permit said bolt to be moved to said open position by said motion imparting means, said unlatching means including an electronic combination lock for providing a current to energize said electromagnet and thereby remove said restraining member and release said bolt when the proper combination is selected, together with manual bolt opening means comprising;

a groove in said bolt opening into said recess on the other side of said restraining member from said electromagnet, and a removal assembly pivotally attached to said bolt and including a pin received in said other groove and a handle, pivoting of said assembly causing said pin to remove said restraining member from said recess to release said bolt, translation of said handle and assembly then moving said bolt to the open position.

4. A lock according to claim 3 wherein said recess is an inclined groove, wherein said bolt slides in a channel having an opening beneath said electromagnet, said inclined groove being aligned beneath said opening when said bolt is in the locking position, and where said restraining member normally rests on the inclined surface of said inclined groove between opposing sides faces of said opening and said groove so as to prevent sliding of said bolt, said restraining member being magnetically attracted out of said inclined groove upon energization of said electromagnet to release said bolt.

5. A lock comprising:

a bolt moveable in a housing between a locking position and and open position, restraining means for preventing said bolt from moving from said locking position, said restraining means being releasable to permit movement of said bolt to said open position, isolated motion imparting means for moving said bolt from said locking position to said open position when said restraining means is released, said motion imparting means being itself moveable but mechanically isolated from said bolt so that no motion is imparted to said bolt when said motion imparting means is moved while said bolt is restrained in said locking position, and unlatching means for selectively releasing said restraining means to permit said bolt to be moved to said open position by said motion imparting means, and wherein said isolated motion imparting means comprises;

a moveable member, a stiff wire attached to said moveable member, and a peg projecting from said bolt, said peg having a hole therethrough, the diameter of said hole being slightly larger than the diameter of said wire, said wire extending through said hole, there being sufficient friction between said wire and the inner surface of said hole so that when said member is moved said wire will pull said peg and bolt to the open position when said bolt is released, said wire sliding through said hole without pulling said peg and bolt when said member is moved while said bolt is restrained in the locking position.

6. A lock comprising:

a bolt moveable in a housing between a locking position and an open position, restraining means for preventing said bolt from moving from said locking position, said restraining means being releasable to permit movement of said bolt to said open position, isolated motion imparting means for moving said bolt from said locking position to said open position when said restraining means is released, said motion imparting means being itself moveable but mechanically isolated from said bolt so that no motion is imparted to said bolt when said motion imparting means is moved while said bolt is restrained in said locking position, and unlatching means for selectively releasing said restraining means to permit said bolt to be moved to said open position by said motion imparting means, and wherein said isolated motion imparting means comprises; a moveable member, a permanent magnet mounted to said member, and a peg projecting from said bolt, said peg being magnetically connected to said permanent magnet so that movement of said member and permanent magnet will impart motion to said peg and bolt when said bolt is not released, said permanent magnet sliding past said peg but not imparting motion to said peg and bolt when said member is moved while said bolt is restrained in the locking position.

7. A lock, comprising:

a bolt movable in a housing between a locking position and an open position, restraining means for preventing said bolt from moving from said locking position, said restraining means being releasable to permit movement of said bolt to said open position, isolated motion imparting means for moving said bolt from said locking position to said open position when said restraining means is released, said motion imparting means being itself movable but mechanically isolated from said bolt so that no motion is imparted to said bolt when said motion imparting means is moved while said bolt is restrained in said locking position, said isolated motion imparting means including a movable handle mounted on one side of a structure to which said lock is affixed, said bolt and said restraining means being mounted to the other side of said structure, a shaft connected to said handle and extending through said structure, a spring situated on said other side of said structure and connected between said shaft and said bolt, so that movement of said handle imparts opening movement to said bolt when said restraining means is released, and wherein like movement of said handle causes expansion of said spring without imparting motion to said bolt when said bolt is restrained, unlatching means for selectively releasing said restraining means to permit said bolt to be moved to said open position by said motion imparting means, said unlatching means including an electromagnet component for releasing said restraining means, a set of pushbuttons and electronic lock circuitry for energizing said electromagnetic component and thereby releasing said restraining means when a certain subset of said pushbuttons is depressed, and manual release means, carried by said bolt, for manually releasing said restraining means from said bolt and for directly, concurrently imparting opening movement to said bolt.

8. A lock according to claim 7 together with;

a faceplate, each of said pushbuttons being slideably mounted in a respective recess in said faceplate, a spring wire for each pushbutton, one end of said spring wire being affixed to said faceplate, the other end of said spring wire extending through a hole in a respective pushbutton, said spring wire biasing said pushbutton to the undepressed position, and an inclined contact for each pushbutton affixed to said faceplate in alignment with the central portion of a respective spring wire between said one end and the respective pushbutton, so that depression of the respective pushbutton will deflect said spring wire into wiping electrical connection with said inclined contact, said spring wire urging said pushbutton back to said undepressed position in which said spring wire is not in electrical connection with said contact upon release of said pushbutton.

9. A lock according to claim 8 wherein said faceplate and pushbuttons are unitary with said handle.

10. A lock according to claim 8 wherein said faceplate is mounted in said handle and is circular, wherein said pushbuttons are arranged in a circle, and wherein all of said spring wire one ends are affixed to said faceplate near the center thereof, with said spring wires extending in a spoke-like radial arrangement.

* * * * *